US006681682B2

(12) United States Patent
Niwa et al.

(10) Patent No.: US 6,681,682 B2
(45) Date of Patent: Jan. 27, 2004

(54) HYDRAULIC CYLINDER

(75) Inventors: Susumu Niwa, Kani (JP); Susumu Kawai, Toyonaka (JP)

(73) Assignee: Kayaba Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/901,872

(22) Filed: Jul. 9, 2001

(65) Prior Publication Data

US 2001/0047719 A1 Dec. 6, 2001

(51) Int. Cl.[7] ..... F01B 31/10
(52) U.S. Cl. ..... 92/153
(58) Field of Search ..... 92/134, 153, 155

(56) References Cited

U.S. PATENT DOCUMENTS 2,700,928 A * 2/1955 Strike ..... 92/153
4,076,103 A * 2/1978 Wallis ..... 92/153
5,052,278 A * 10/1991 Smillie et al. ..... 92/155
5,086,691 A * 2/1992 von Hatten ..... 92/153
5,140,894 A * 8/1992 Snyder et al. ..... 92/134

* cited by examiner

*Primary Examiner*—E. Daniel Lopez
(74) *Attorney, Agent, or Firm*—McGlew and Tuttle, P.C

(57) ABSTRACT

A single-acting type hydraulic cylinder which is operated to be expanded and contracted by supply and discharge of liquid pressure from a so-called bottom side, in which the desired operation is permanently secured without bringing forth abrasion of a bushing or damage of a dust seal caused by rust or scratching in the outer circumference of a rod body. A hydraulic cylinder which is operated to be expanded and contracted by supply and discharge of liquid pressure P to a liquid chamber R partitioned on the bottom side within a cylinder body 1, characterized in that a head member 4 forming an open end of the cylinder body 1 is provided with a lubrication means 7 in sliding contact with the outer circumference of a rod body 3 and an oil seal 8 in series between a bushing 5 and a dust seal 6.

5 Claims, 2 Drawing Sheets

(PRIOR ART)

HYDRAULIC CYLINDER

FIELD OF THE INVENTION

The present invention relates to a hydraulic cylinder, and particularly to an improvement in a single-acting type hydraulic cylinder suitable for use with a forklift.

BACKGROUND OF THE INVENTION

In the past, a single-acting type hydraulic cylinder for a forklift is operated to be extended, for example, as shown in FIG. 2, when liquid pressure P is supplied from the outside to a liquid chamber R which is a chamber on the counter rod side partitioned by a piston 2 slidably inserted into a cylinder body 1.

Further, the hydraulic cylinder is operated to be contracted when a supply of liquid pressure P to the liquid chamber R is released whereas a rod body 3 having a proximal end connected to the piston 2 gets into the cylinder body 1 due to own weight or load exerting on the extreme end to contract the liquid chamber R through the piston 2.

At this time, the rod side chamber partitioned by the piston 2 within the cylinder body 1 which is an air chamber A is in many cases communicated with the atmosphere outside the cylinder body 1 through a communication hole 1*a* bored in the cylinder body 1.

On the other hand, the rod body 3 which moves in and out of the cylinder body 1 extends through an axial part of a head member 4 forming an open end of the cylinder body 1. At this time, a bushing 5 for causing the outer circumference of the rod body 3 to slidingly contact therewith is disposed in the inner circumference internally of the cylinder body 1 in the head member 4, and a dust seal 6 for causing the outer circumference of the rod body 3 to slidingly contact therewith is disposed in the inner circumference of an open end in the head member 4.

Therefore, in the hydraulic cylinder, for example, when it is used for a forklift, a fork loaded with baggage can be moved up by the extension action thereof, and the fork loaded with baggage can be moved down by the contraction action thereof. At this time, when the rod body 3 is moved in and out of the cylinder body 1, the bushing 5 compensates for slidability of the rod body 3 with respect to the head member 4 whereas the dust seal 6 wipes out so-called dust adhered to the outer circumference of the rod body 3 so that dust is not drawn into the cylinder body 1.

However, the conventional hydraulic cylinder shown in FIG. 2 involves a fear that when the rod body 3 is moved in and out of the cylinder body 1, so-called heat generation occurs, and rust, discoloration and scratch due to the beat generation appear on the outer circumference of the rod body 3.

That is, in the above-described hydraulic cylinder, since the rod side chamber partitioned by the piston 3 within the cylinder body 1 comprises the air chamber A, a so-called "dry" condition is formed between the inner circumference of the bushing 5 and the outer circumference of the rod body 3, tending to poor lubrication as compared with the case of a so-called "wet" condition where an oily sliding coating is formed.

Therefore, when sliding movement is frequently repeated between the rod body 3 and the bushing 5, particularly when sliding movement such that the rod body 3 is pressed against the bushing 5 is repeated, a heat generation phenomenon tends to appear between the inner circumference of the bushing 5 and the outer circumference of the rod body 3.

Then, when the heat generation phenomenon appears, a degeneration is brought forth in the outer circumference of the rod body 3 due to the heat generation, and rust or discoloration appears on the outer circumference of the rod body 3 due to the degeneration.

At this time, also in the bushing 5, abrasion is accelerated to deteriorate a function of the bushing, and scratching occurs on the outer circumference of the rod body 3, resulting in damage of even the dust seal 6.

As a consequence, occurrence of rust or formation of scratches in the outer circumference of the rod body 3 further lowers the so-called slidability of the rod body 3 with respect to the cylinder body 1, posing an inconvenience making it impossible to expect the desired permanent operation of the hydraulic cylinder.

SUMMARY OF THE INVENTION

The present invention has been created in view of the above described circumstances, and has its object to provide a single-acting type hydraulic cylinder which is operated to be expanded and contracted by supply and discharge of liquid pressure from the so-called bottom side, the hydraulic cylinder being optimum for permanently securing the desired operation without bringing forth abrasion of a bushing and damage of a dust seal caused by rust or scratching in the outer circumference of a rod body.

For achieving the aforementioned object, the present invention provides a hydraulic cylinder fundamentally constituted such that the cylinder is operated to be extended when liquid pressure from outside is supplied to a liquid chamber which is a counter rod side chamber partitioned by a piston slidably inserted into a cylinder body. The cylinder is operated to be contracted when a supply of liquid pressure to the liquid chamber is released whereas a rod body having a proximal end connected to a piston is moved into the cylinder body due to its own weight or load exerting on the extreme end. A head member forming an open end of a cylinder body for moving in and out of the rod body has a bushing for causing the outer circumference of the rod body to sliding contact therewith and a dust seal. The hydraulic cylinder, in the head member, comprising in series, a lubrication means in sliding contact with the outer circumference of the rod body on the bushing side between the bushing and the dust seal, and an oil seal in sliding contact with the outer circumference of the rod body on the dust seal side.

In the above-described constitution, more concretely, the lubrication means is for example, a lubricating material such as grease stored in an inner circumferential groove at a predetermined position formed in the inner circumference of the head member, or a suitable impregnate material received in the inner circumferential groove, the impregnate material being impregnated with a suitable lubricating material.

Further, the rod side chamber partitioned by a piston within the cylinder body comprising an air chamber is communicated with the atmosphere outside the cylinder body through a communication hole bored in the cylinder body, or is set to an air spring chamber having a seal construction not in communication with the atmosphere outside the cylinder body while being an air chamber.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
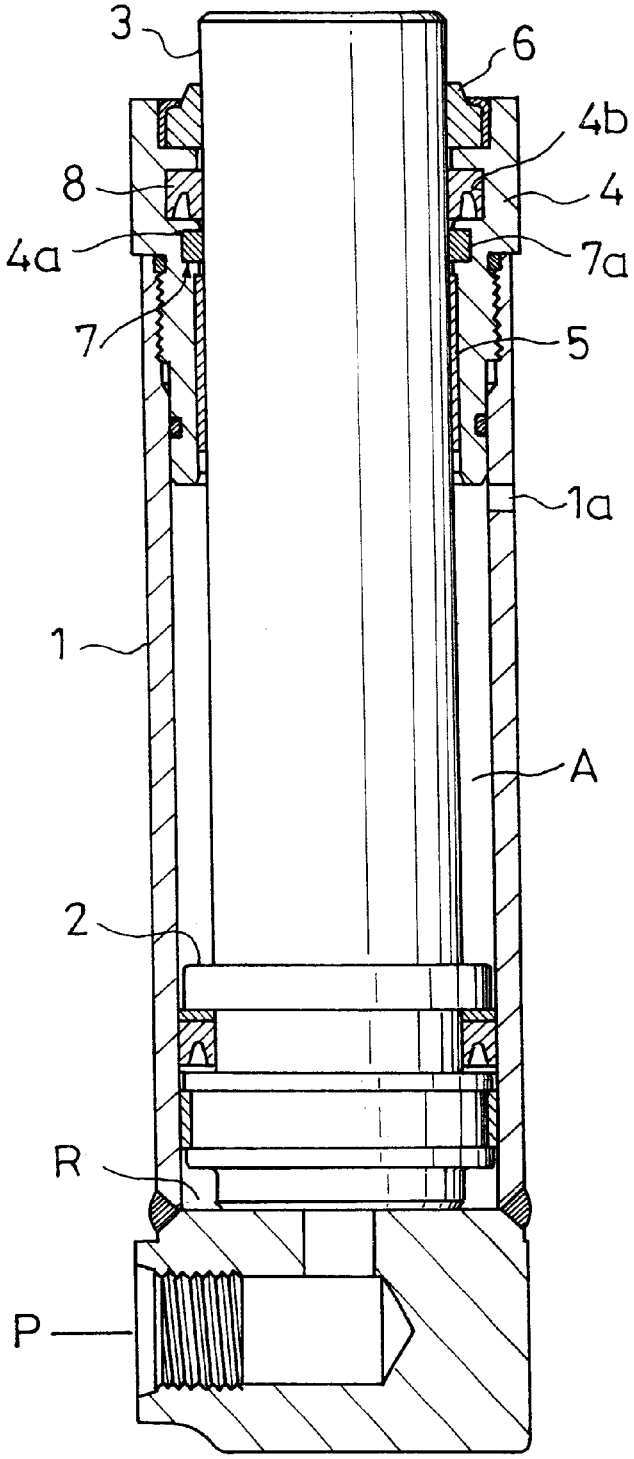
FIG. 1 is a partly cutaway cross sectional view of a hydraulic cylinder according to one embodiment of the present invention.

Referring to the drawings in particular, the present invention will be described on the basis of an embodiment shown in the figure. As shown in FIG. 1, the hydraulic cylinder according to the present invention is also constituted fundamentally similar to the aforementioned conventional hydraulic cylinder, which is set to a single-acting hydraulic cylinder operated to be expanded and contracted by a supply and discharge of liquid pressure P from so-called bottom side.

Figure 2:
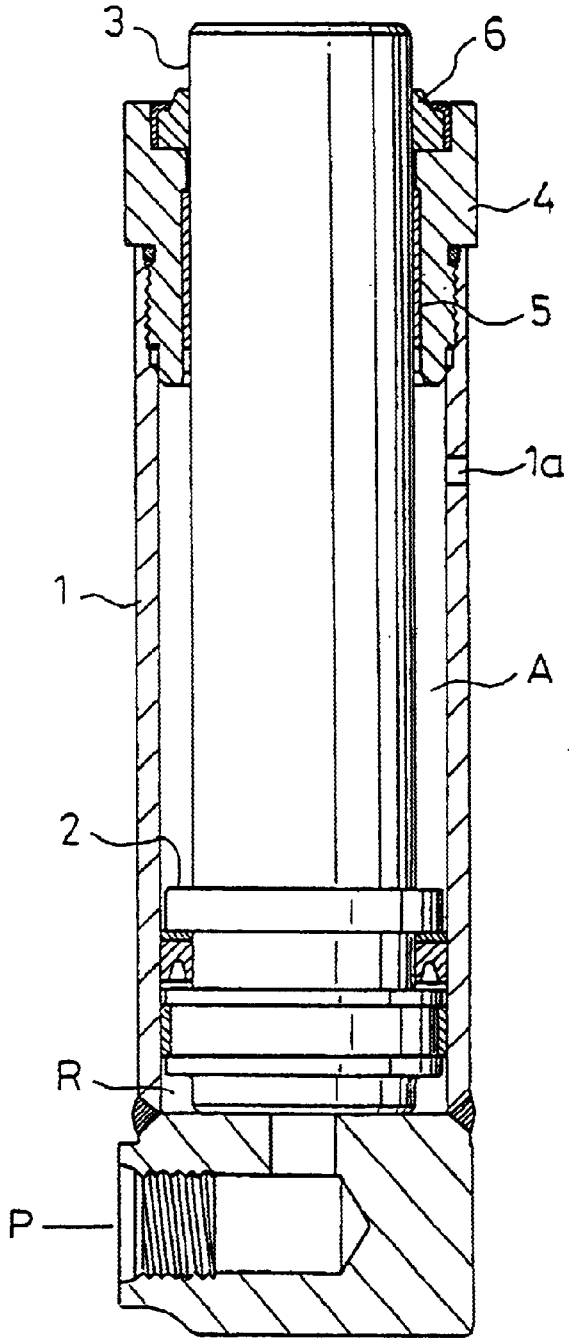
FIG. 2 is a partly cutaway cross sectional view of a conventional hydraulic cylinder.

Therefore, in the following description, with respect to the constitution similar to that of the prior art shown in FIG. 2, parts thereof are designated by the same reference numerals in the figure except those as necessary, details of which are omitted.

That is, in the hydraulic cylinder according to the present invention, a bushing 5 is provided in the inner circumference inside a cylinder body 1 in a head member 4, and a dust seal 6 is provided in the inner circumference of an open end in the head member 4. A lubrication means 7 and an oil seal 8 are provided in series between the bushing 5 and the dust seal 6, that is, in series in an axial direction of a rod body 3.

At this time, in the inner circumference of the head member 4, the lubrication means 7 is located on the bushing 5 side, that is, on the air chamber A side within the cylinder body 1 whereas the oil seal 8 is located on the dust seal 6 side, that is, on the external side of the cylinder body 1 to prevent the lubrication effect of the lubrication means from so-called escaping outside the cylinder body 1 by the oil seal 8.

Incidentally, in the illustration, the lubrication means 7 stores, for example, a lubricating material 7*a* such as grease within an inner circumferential groove 4*a* at a predetermined position formed in the inner circumference of the head member 4.

Incidentally, the lubrication means 7 will suffice, as a result, to form a lubricating coating (not shown and not designated by symbol) between the inner circumference of the bushing 5 and the outer circumference of the rod body 3. Therefore, in place of the above-described constitution, a suitable impregnate material may be received in the inner circumferential groove 4*a*, and a suitable lubricating material, that is, the lubricating material 7*a* such as grease described above may be impregnated in the impregnate material.

On the other hand, since the oil seal 8 comprises a so-called U packing received in an inner circumferential groove 4*b* at a predetermined position formed in the inner circumference of the head member 4 similar to the above-described inner circumferential groove 4*a*, the inner circumference of which comes in sliding contact with the outer circumference of the rod body 3.

At this time, the oil seal 8 has a function such that a lubrication coating from the internal side of the cylinder body 1 adhered to the outer circumference of the rod body 3, that is, from the lubrication means 7 side is remained on the lubrication means 7 side so as to prevent the coating from flowing out to the external side of the cylinder body 1, that is, to the dust seal 6 side.

Therefore, the hydraulic cylinder according to the present invention is operated to be extended, for example, when it is used for a forklift, when liquid pressure P from the outside is supplied to a liquid chamber R partitioned by a piston 2 within the cylinder body 1, at which time a fork loaded with baggage is to be moved up.

Further, when likewise it is used for a forklift, a supply of liquid pressure P to the liquid chamber R is released, whereas the hydraulic cylinder is operated to be contracted when the rod body 3 is moved into the cylinder body 1 due to a load such as its own weight, at which time a fork loaded with baggage is to be moved down.

In the foregoing, the air chamber A which is a rod side chamber partitioned within the cylinder body 1 is communicated with the atmosphere outside the cylinder body 1 through a communication hole 1*a* bored in the cylinder body 1, and therefore, the above-described expansion and contraction operation is realized without so-called resistance.

Further, at the time of the above-described expansion and contraction, that is, at the time when the rod body 3 is moved in and out of the cylinder body 1, the outer circumference of the rod body 3 comes in sliding contact with not only the bushing 5 and the dust seal 6 disposed in the inner circumference of the head member 4 forming an open end of the cylinder body 1 but also the lubrication means 7 and the oil seal 8.

At this time, the bushing 5 secures slidability of the rod body 3 with respect to the cylinder body 1 whereas the dust seal 6 prevents entry of dust adhered to the outer circumference of the rod body 3 into the cylinder body 1.

At the same time, the lubrication means 7 forms a lubrication coating between the inner circumference of the bushing 5 and the outer circumference of the rod body 3 to lower sliding friction therebetween, and the oil seal 8 is able to prevent the lubricating material 7*a* forming a lubrication coating from escaping to the external side of the cylinder body 1, thus permanently securing lubrication between the bushing 5 and the rod body 3.

In the foregoing, in the hydraulic cylinder, the rod side chamber partitioned by the piston 2 within the cylinder body 1 comprises the air chamber A which is communicated with the atmosphere outside the cylinder body 1 through the communication hole 1*a* bored in the cylinder body 1, but in place thereof, though not shown, there can be employed an air spring chamber having a seal construction in which the air chamber A is not communicated with the atmosphere outside the cylinder body 1.

And, in a case where the air chamber A is set in the air spring chamber, there is an advantage in that when the extended hydraulic cylinder is contracted, contraction of the hydraulic cylinder is quickly realized by spring reaction generated in the air spring chamber.

Further, in the foregoing, the oil seal 8 is disposed adjacent to the dust seal 6, but in place thereof, though not shown, the lubrication means 7 of the present invention may be further provided therebetween. In this case, the outer circumference of the rod body 3 which is so-called dry in the oil seal 8 can be maintained to be wet, which is advantageous in that further lubrication is secured.

As described above, in the present invention, it becomes possible to effect expansion and contraction operation for moving the rod body in and out of the cylinder body by a supply and discharge of liquid pressure to the liquid chamber partitioned on the bottom side within the cylinder body. When the hydraulic cylinder is used, for example, for a forklift, it becomes possible to elevate the fork loaded with baggage.

At this time, in a case where the air chamber which is a rod side chamber partitioned within the cylinder body is communicated with the atmosphere outside the cylinder body, the expansion and contraction operation is realized without so-called resistance, and further, in a case where the air chamber is set in the air spring chamber having a seal construction, contraction of the hydraulic cylinder extended by spring reaction generated in the air spring chamber can be realized quickly.

Further, in the above-described expansion and contraction, that is, when the rod body is moved in and out of the cylinder body, the outer circumference of the rod body comes in sliding contact with the bushing disposed in the inner circumference of the head member forming an open end of the cylinder body to secure slidability of the rod body to the cylinder body; the dust seal disposed in the inner circumference of the head member prevents dust adhered to the outer circumference of the rod body from entering the cylinder body with the lubrication means disposed between the bushing and the dust seal forming a lubrication coating between the inner circumference of the bushing and the outer circumference of the rod body to lower sliding friction therebetween; and the oil seal disposed in series with the lubrication means and in the inner circumference of the head member enables to prevent the lubricating material forming the lubrication coating from escaping to the external side of the cylinder body to permanently secure lubrication between the bushing and the rod body.

Moreover, with respect to the disposition of the lubrication means and the oil seal, a slight change in design of the head member will suffice, not requiring a large scaled change in design.

As a result, according to the present invention, there is provided a single-acting type hydraulic cylinder subjected to expansion and contraction operation by supply and discharge of liquid pressure from the so-called bottom side, which does not bring forth rust or scratching in the outer circumference of the rod body but is optimum for permanently securing the desired operation.

While specific embodiments of the invention have been shown and described in detail to illustrate the application of the principles of the invention, it will be understood that the invention may be embodied otherwise without departing from such principles.

What is claimed is:

1. A hydraulic cylinder comprising:

a cylinder body;

a head member mounted to an end portion of said cylinder body, said head member having an inner circumference;

a dust seal mounted at an axial end of said head member;

a bushing, said bushing and said dust seal being provided in series arranged on said inner circumference of said head member with said bushing disposed axially inwardly of said dust seal;

a piston in said cylinder body;

a rod body slidably inserted into said cylinder body and through said bushing and through said dust seal with an end connected to said piston, said piston partitioning the inside of said cylinder body into an air spring chamber on a rod side and a liquid chamber on a counterrod side, said rod body extending from said cylinder toward an expanded position upon a supply of liquid pressure to the liquid chamber and returning to a contracted position upon a cancellation of liquid pressure, said head member having a first inner circumferential groove and a second inner circumferential groove in series along an axial direction of said inner circumference of said head member and between said bushing and said dust seal;

lubricating material stored in said first inner circumferential groove adjacent to said bushing and between said bushing and said dust seal; and an oil seal provided in said second inner circumferential groove adjacent to said dust seal.

2. A hydraulic cylinder according to claim 1 wherein said lubricating material is grease stored in said first inner circumferential groove of said head member.

3. A hydraulic cylinder comprising:

a cylinder body;

a head member mounted to an end portion of said cylinder body, said head member having an inner circumference;

a dust seal;

a bushing, said bushing and said dust seal being provided in series arranged on said inner circumference of said head member with said bushing disposed axially inwardly of said dust seal in relation to said end portion;

a piston in said cylinder body;

a rod body slidably inserted into said cylinder body and through said bushing and said dust seal, said rod body having an end connected to said piston, said piston partitioning the inside of said cylinder body into an air spring chamber on a rod side and a liquid chamber filled with liquid on a side of said piston opposite to said air spring chamber, said rod body being movable toward an expanded position, extending from said cylinder, upon a supplying liquid under pressure to the liquid chamber and returning to a contracted position upon a cancellation of the supply of liquid under pressure, said head member having a first inner circumferential groove and a second inner circumferential groove in series along an axial direction of said inner circumference of said head member and between said bushing and said dust seal;

grease stored in said first inner circumferential groove adjacent to said bushing between said bushing and said dust seal; and an oil seal provided in said second inner circumferential groove adjacent to said dust seal and between said first inner circumferential groove and said dust seal.

4. A hydraulic cylinder comprising:

a cylinder body;

a head member mounted to an end portion of said cylinder body, said head member having an inner circumferential surface;

a dust seal;

a bushing, said bushing and said dust seal being provided in series arranged on said inner circumferential surface of said head member;

a piston in said cylinder body;

a rod body slidably inserted into said cylinder body and through said bushing and said dust seal, said rod body having an end connected to said piston, said piston partitioning the inside of said cylinder body into an air spring chamber on a rod side and a liquid chamber on a counterrod side, said rod body extending from said cylinder toward an expanded position upon a supply of liquid pressure to the liquid chamber and returning to a contracted position upon a cancellation of liquid pressure, said head member having a first inner circumferential groove and a second inner circumferential groove in series along an axial direction of said inner circumference of said head member and between said bushing and said dust seal;

lubricating material stored in said first inner circumferential groove adjacent to said bushing; and an oil seal provided in said second inner circumferential groove adjacent to said dust seal.

5. A hydraulic cylinder according to claim 4, wherein said lubricating material is grease stored in said first inner circumferential groove of said head member.

* * * * *